US005377941A

United States Patent [19]

Har et al.

[11] Patent Number: 5,377,941

[45] Date of Patent: Jan. 3, 1995

[54] SUPPORT FRAME FOR SINK WASTE BAGS

[75] Inventors: Michael Har, 304 S. Court, Fairfield, Iowa 52556; John Stimson, Fairfield, Iowa

[73] Assignee: Michael Har, Fairfield, Iowa

[21] Appl. No.: 114,373

[22] Filed: Aug. 30, 1993

Related U.S. Application Data

[63] Continuation-in-part of Ser. No. 933,030, Aug. 20, 1992, abandoned.

[51] Int. Cl.[6] ..... B65B 67/04

[52] U.S. Cl. ..... 248/101; 4/629; 248/95

[58] Field of Search ..... 248/99, 100, 101, 95; 220/403, 404; 383/33; 4/629

[56] References Cited

U.S. PATENT DOCUMENTS

| | | | |
|---|---|---|---|
| 1,830,781 | 11/1931 | Brotz | 4/629 X |
| 3,679,160 | 7/1972 | Ballenger | 248/101 |
| 4,238,868 | 12/1980 | Sternberg | 248/101 X |
| 4,378,924 | 4/1983 | Christensen | 248/101 |
| 4,531,246 | 7/1985 | Earley | 4/629 |
| 4,715,572 | 12/1987 | Robbins | 248/101 |
| 4,750,695 | 6/1988 | Greenhouse | 248/99 |
| 4,919,546 | 4/1990 | Imazeki | 383/33 |
| 4,951,903 | 8/1990 | Frey | 248/99 |
| 4,984,758 | 1/1991 | Young | 248/95 |
| 4,984,759 | 1/1991 | Perlant | 248/99 |
| 5,002,245 | 3/1991 | Hansen | 248/99 |

*Primary Examiner*—J. Franklin Foss
*Attorney, Agent, or Firm*—Robbins & Robbins

[57] ABSTRACT

A device is provided for holding a disposal waste bag in a kitchen sink. The device comprises an open frame through which the waste bag may be inserted with the bottom of the bag supported upon the floor of the sink in order that the load of the waste is not placed on the support frame. The top portion of the bag is folded over the frame with provisions for clamping the folded over portion to retain the bag. The clamping may be effected between the frame, which may be hinged to receive the bag, and a support base, the corner, rims or at an elevated portion of side walls of the sink or clamping at a slot or a clip on the frame. The hinge may include a hinged lid or the like. The frame may be folded in half to close the top of the bag. The support frame or a hinge for the frame is conveniently affixed by suction cups, glue or the like, to the sink either at an elevated part of the side wall or upon the top rim at the corner or a side of the sink.

21 Claims, 13 Drawing Sheets

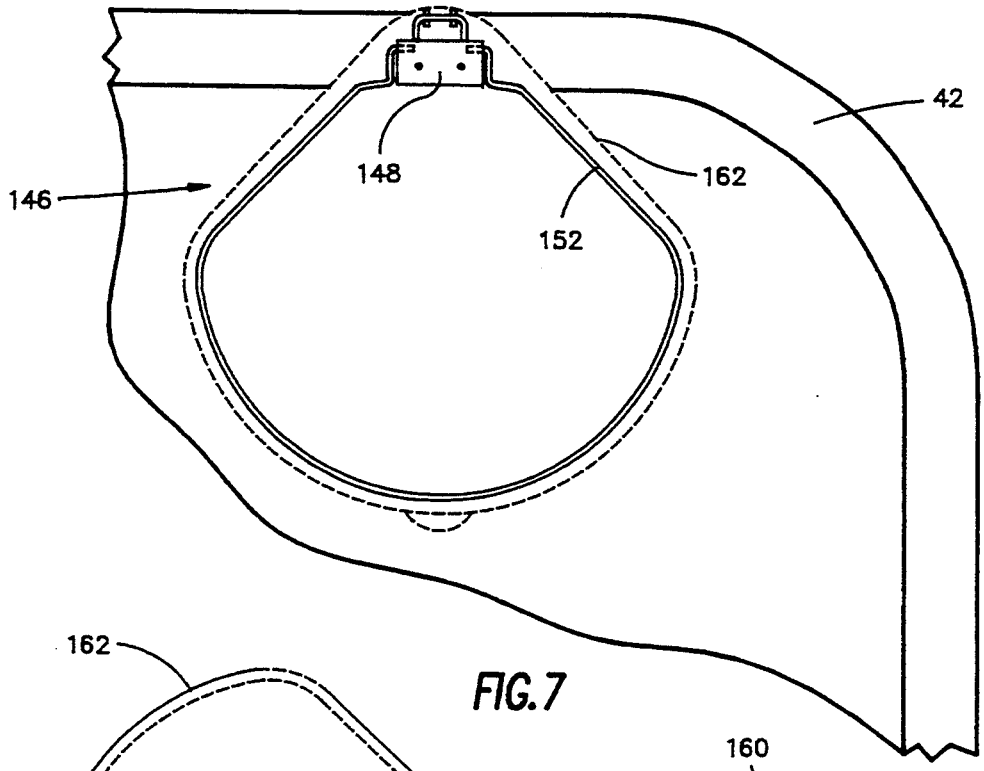
FIG. 7
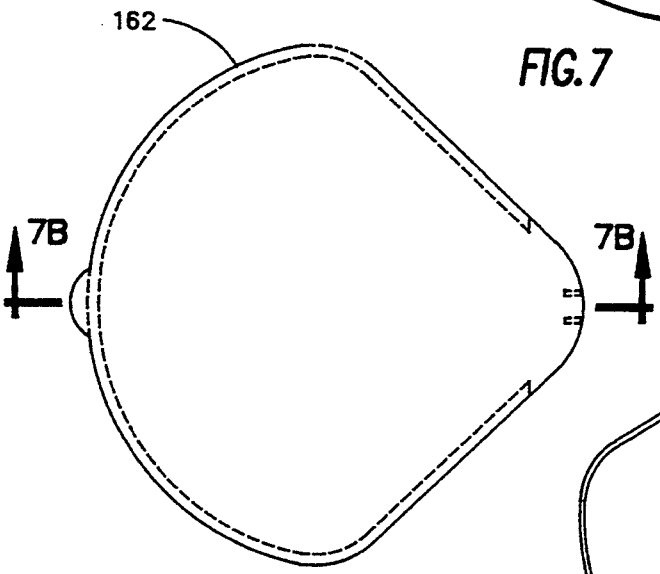
FIG. 7A
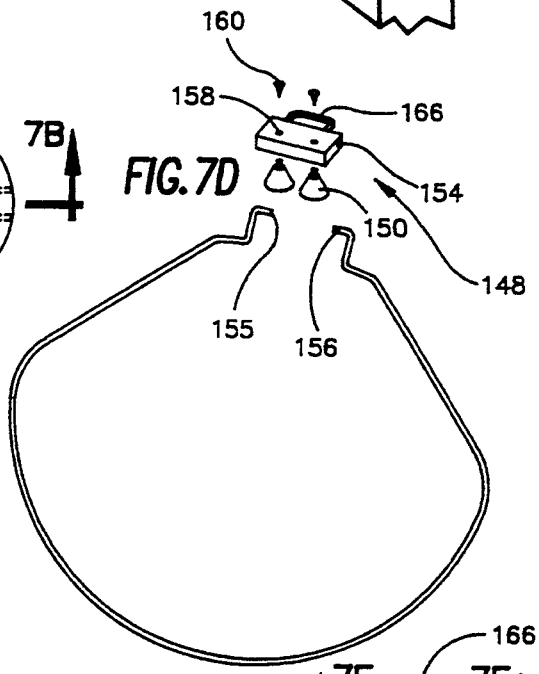
FIG. 7D
FIG. 7C
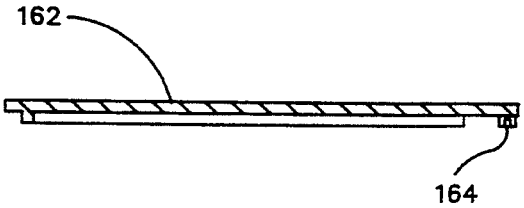
FIG. 7B
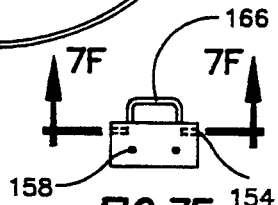
FIG. 7E
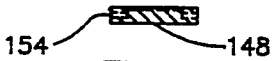
FIG. 7F

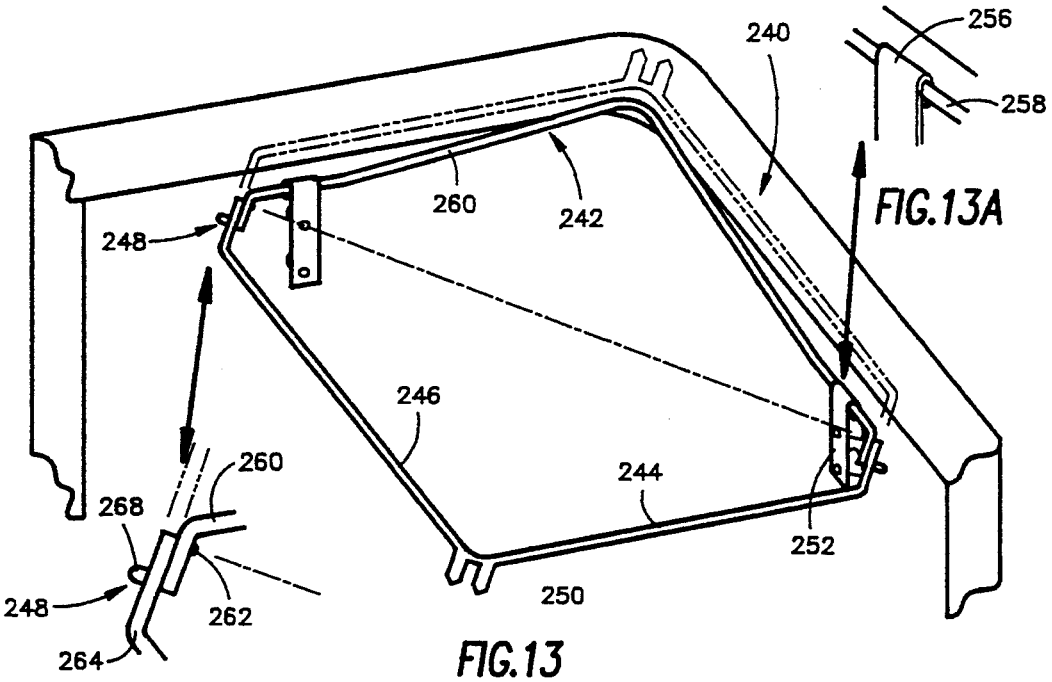
FIG.13A
FIG.13
FIG.13B
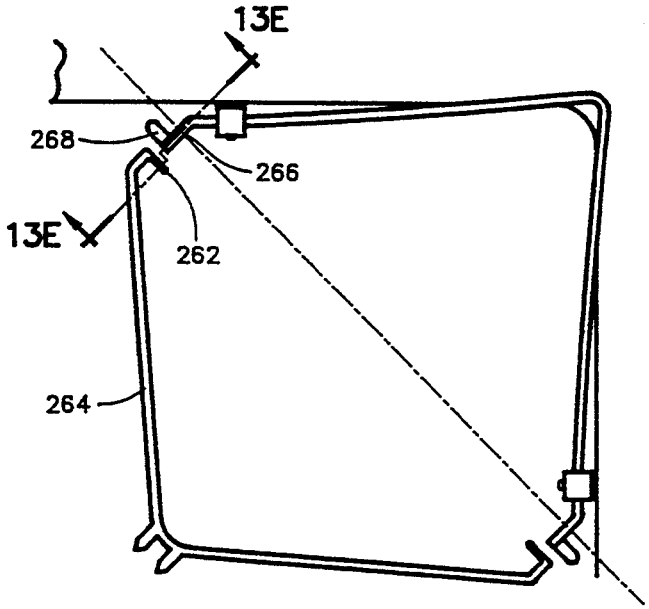
FIG.13D
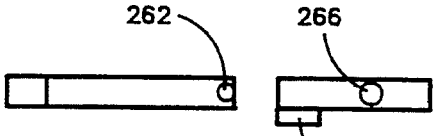
FIG.13E
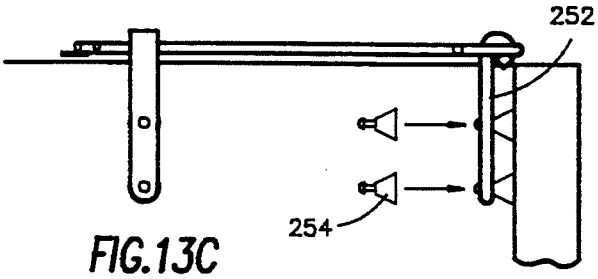
FIG.13C

SUPPORT FRAME FOR SINK WASTE BAGS

This application is a continuation-in-part of application Ser. No. 07/933,030 filed August 20, 1992now abandoned.

BACKGROUND OF THE INVENTION

In the past there has been both a problem and inconvenience for disposal of garbage and other waste that is generated around a kitchen sink or the like. Major amounts of waste are usually removed to a separate waste container, usually an upright container supported on the kitchen floor.

However, in the case of small amounts of waste, it has been troublesome and an interruption of time to carry such waste to the separate area where the floor supported waste container is located. Such containers may have a foot treadle or other means for opening the top for disposal of waste which requires a significant amount of time for operation.

Small foramens trays of triangular or other shape that are supported upon the sink floor, have been conventionally employed in the past but such trays are unsightly and messy to employ in handling and emptying. Cleaning for reuse after disposal is a further inconvenience.

There is in the market also a small wire holder device in the shape of a triangular cage prism-like construction having high side walls made of bent wire, including sides and base, to support an open trash bag in the corner of a sink.

This device needs a lot of space. Even when the bag is empty, it slides in the sink, needs to be cleaned and has no lid. Moreover, it has no clamping for holding the bag, is inconvenient to load and unload the bag and needs relatively more material which increases the price.

This prism shaped device is better than the old tray of triangular shape, but still has significant disadvantages which are solved by this invention.

It has remained a problem to provide a simple and convenient device for disposing of small amounts of waste generated around a kitchen sink.

SUMMARY OF THE INVENTION

By means of this invention, there has been provided a device for supporting a bag upon a floor of the sink. The top of the bag is presented with an open mouth in order that garbage or other waste material may be easily placed in the bag. The weight of the waste material within the bag is supported upon the kitchen sink floor in order that no stress or strain is borne by the bag.

The support device for the bag in its simplest form is a frame with an open center through which the empty bag is emplaced with the bottom of the bag resting upon the sink floor. The frame has a form that enables it to be positioned upon the top of the sink or an elevated portion of the side wall. The top edges of the bag are then folded over the open frame and retained between the frame and the top or side wall of the sink.

The support frame may be configured in various shapes, such as generally triangular for fitting in the corner of a sink, elliptical, or D-shaped, for use in a corner or side wall of other shapes having an opening through which the waste bag may be interfitted with the bottom resting upon the sink floor and the top edges folded over the waste bag between the frame and the sink in a clamped or retained position. The hinges may be supported on the sink by suction cups, adhesive or the like.

The bag support device may also be provided with a hinged lid in order to cover the waste in the waste bag. The lid is generally contoured with the support frame and may be designed to aid in the retaining of the folded over top edges of the waste bag.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS.,

FIG. 7 is a top plan view of a further modified waste bag support;

FIG. 7A is a top plan view of the support lid;

FIG. 7B is a view in section taken on line 7B—7B of FIG. 7A;

FIG. 7C is a top plan view of the support frame;

FIG. 7D is a pictorial view of a hinged support block;

FIG. 7E is a top plan view of the support block;

FIG. 7F is a view in section taken on line 7F—7F of FIG. 7E;

FIG. 13 is a pictorial view of a further modified waste bag support;

FIG. 13A is an enlarged pictorial view showing a portion of the frame support;

FIG. 13B is an enlarged pictorial view showing the frame hinge;

FIG. 13C is a fragmentary view in side elevation showing the suction cup support;

FIG. 13D is a top plan view; and

FIG. 13E is a view in section taken on line 13E—13E of FIG. 13D.

DESCRIPTION OF THE INVENTION

Figure 1:
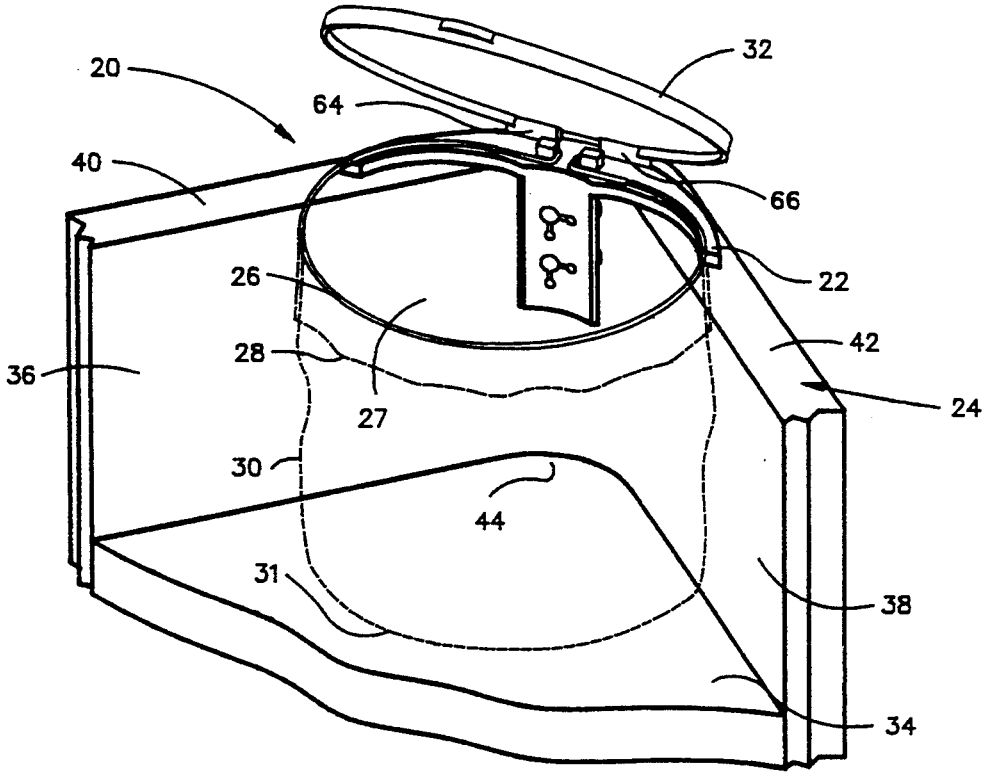
FIG. 1 is a pictorial view of the front and top portion of the waste bag support installed in the corner of a sink.

The sink waste bag support device of this invention is generally indicated by the reference numeral 20 in FIG. 1. It is comprised of a support base 22 supported on a corner rim of sink 24. A support frame having a large central opening 27, is hingedly mounted upon the support base to receive folded over top edges 28 of a waste or garbage bag 30 shown in dotted line over the top of the sink and support base and under the support frame in clamping relation. A hinged lid 32, generally congruent with the support frame is employed to cover the support frame and bag.

The sink 24 is of conventional construction and is comprised of a floor 34, vertical side walls 36 and 38, and horizontal top rims 40 and 42 merging at right angles to a sink corner 44. In most sinks, corners are at right angles. In some sinks the angles are 100° or even up to 120°.

Figure 1A:
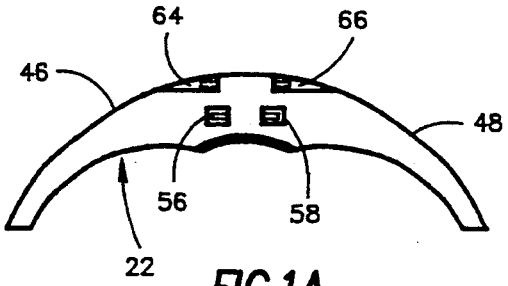
FIG. 1A is a top plan view of the waste bag support base.
Figure 1C:
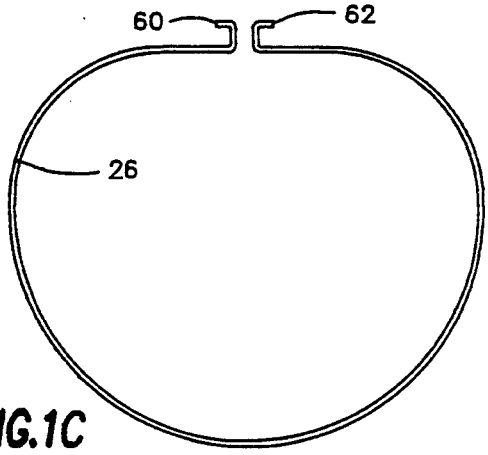
FIG. 1C is a top plan view of the hinged frame.
Figure 1B:
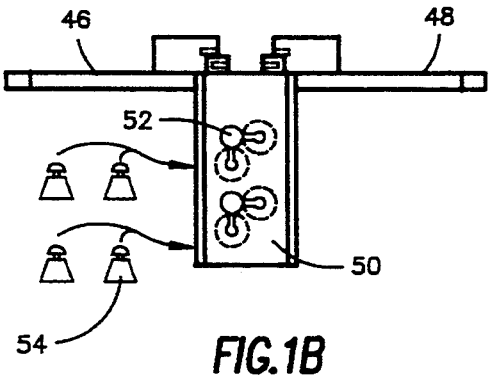
FIG. 1B is a view in front elevation of the support base.

The support base, as shown in FIGS. 1, 1A and 1B, has legs 46 and 48 adapted to rest flat on the corner rims of the sink and a vertical shank 50 nesting in the sink corner. Openings 52 are provided to receive suction cups 54 to secure the shank to the sink.

In order to mount the support frame 26 for raising and lowering it, a pair of hinge blocks 56 and 58 are mounted on the support base, have holes receiving legs 60 and 62 of the support frame as shown in FIGS. 1 and 1C.

Figure 1D:
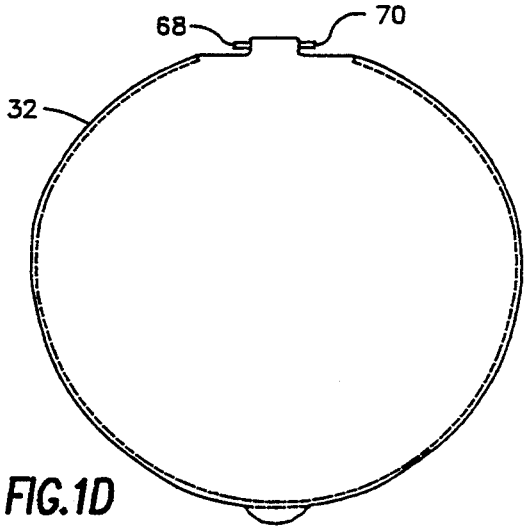
FIG. 1D is a top plan view of the hinged cover.

A similar mounting for hinging the lid 32 is provided by hinge blocks 64 and 66 which receive legs 68 and 70 of the lid as shown in FIG. 1 and 1D.

The support device is readily employed by raising the support frame 26 and lid 32 (the latter being raised to a greater degree) and inserting in the opening 27, a waste bag, which may be of conventional plastic or the like. The bag is of a proper size to rest the bag bottom 31 on the floor 34 of the sink. The top edges 28 of the bag are then folded over the support frame and tucked under it and over the support base and corner rims of the sink with the support frame being lowered to provide a clamping action. The lid may then be lowered to cover the support frame and the top bag opening. Removal of the waste bag may be effected in reverse order. The separate hinging of the support frame and lid provides a convenience and efficiency in both the loading and removal of the waste bag.

Figure 2:
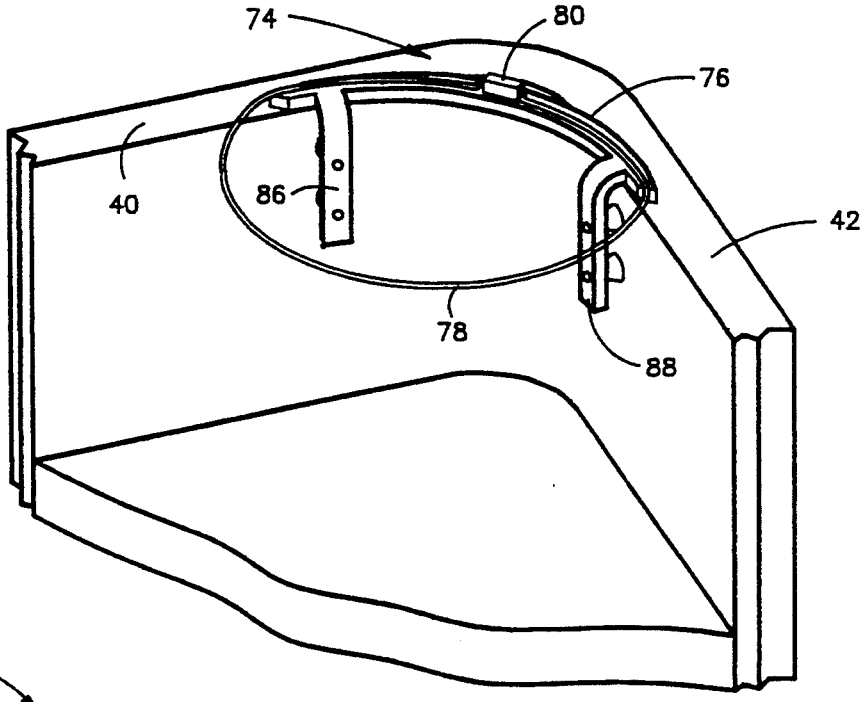
FIG. 2 is a pictorial view of the front and top portion of a modified waste bag support installed in the corner of a sink.
Figure 2B:
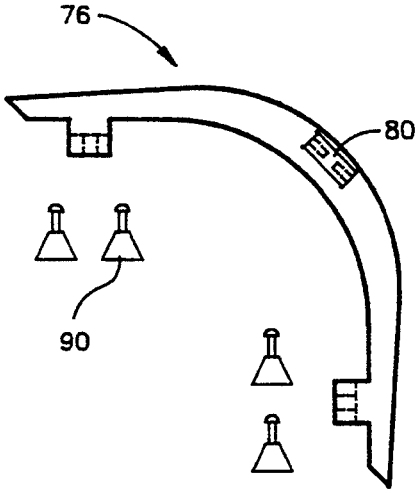
FIG. 2B is a top plan view of the support base.
Figure 2C:
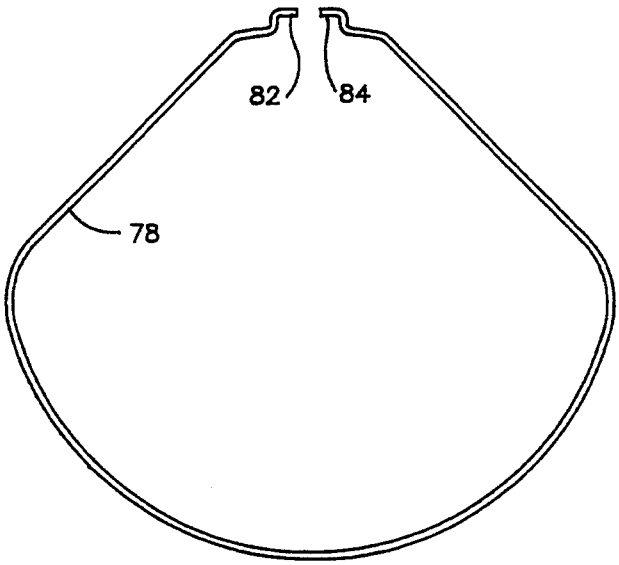
FIG. 2C is a top plan view of the hinged bag support frame.
Figure 2A:
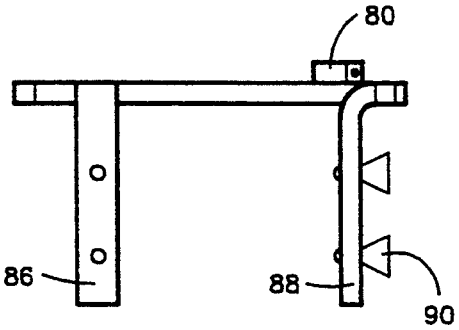
FIG. 2A is a view in right side elevation of the support base.

A modified sink waste bag support device 74 is shown in FIGS. 2–2C employing a sink and waste bag of the same type as shown in FIG. 1 as will be the case for all the modifications of this invention. A support base 76 is employed resting on the corner rims 40 and 42 of the sink. A support frame 78 is hingedly mounted to holes in a hinge block 80 by inturned legs 82 and 84 as best shown in FIGS. 2 and 2C. The support frame is generally in the form of a right triangle with the legs of the triangle resting on the sink corner and the hypotenuse being in the form of an arc to receive the waste bag.

The support base 76 has vertical legs 86 and 88 which receive suction cups 90. The suction cups are affixed to the side walls 36 and 38 of the sink with the support base resting flat on the corner rims of the sink. As in the case of the embodiment 20 in FIG. 1, the suction cups enable the support device to be easily affixed to the sink and removed as desired. The waste bag is installed and removed by raising and lowering the support frame in the same manner as previously described.

Figure 3:
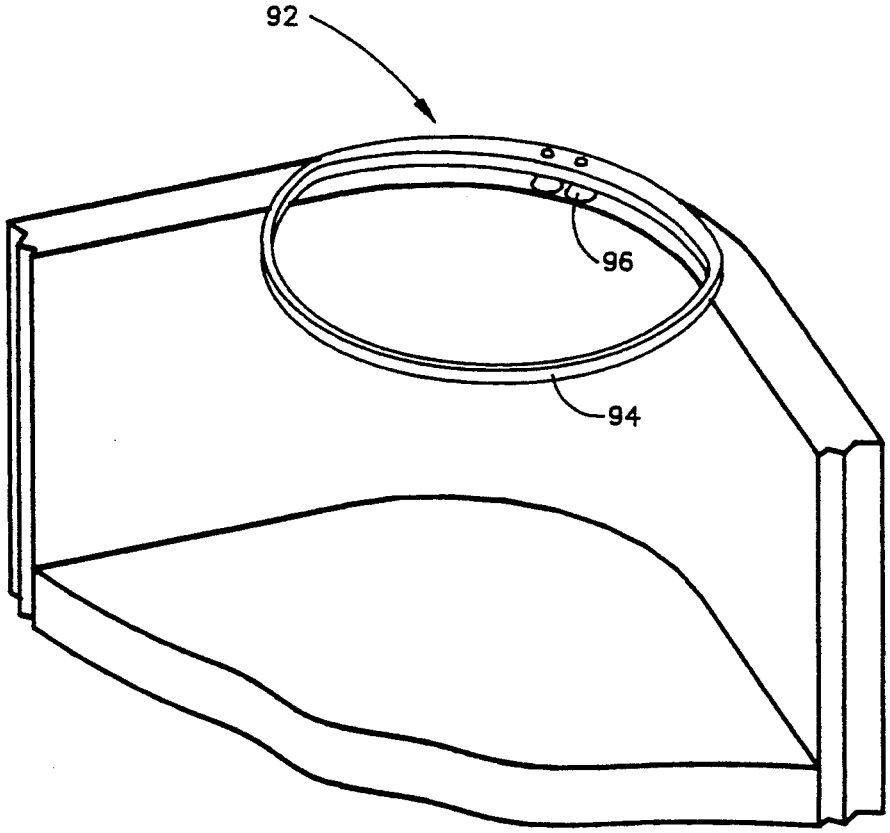
FIG. 3 is a pictorial view of a further modified waste bag support in a sink corner.
Figure 3A:
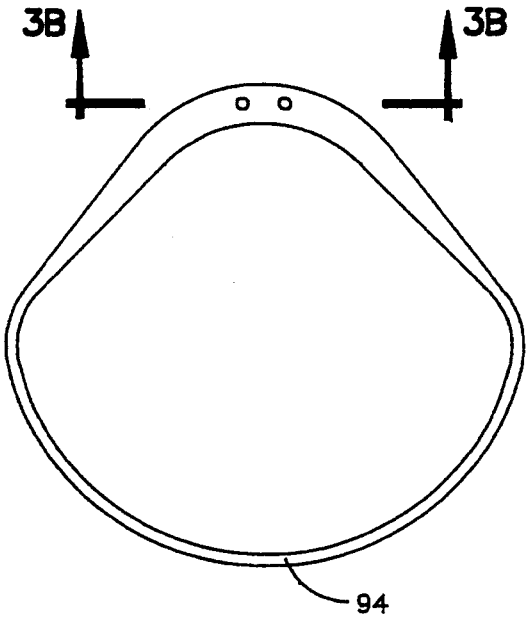
FIG. 3A is a top plan view of the support frame.
Figure 3B:
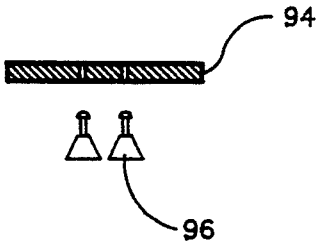
FIG. 3B is a view in section taken on line 3B—3B of FIG. 3A.

A further modified sink waste bag support device 92 is shown in FIGS. 3, 3A and 3B. A support frame 94 is provided with a pair of suction cups 96 which are adapted to be emplaced on the sink corner. Flexibility provided by the rubber suction cup and plastic construction of the support frame permit the support frame to be raised and lowered to tuck in the folded over top edges of the waste bag between the rims of the sink and the support frame.

Figure 4:
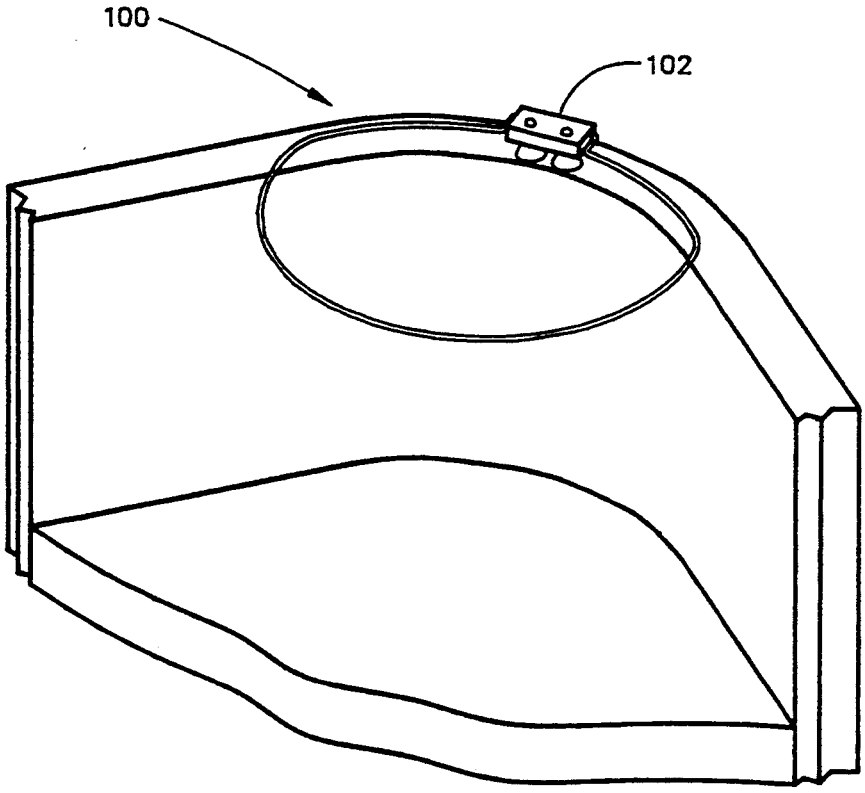
FIG. 4 is a pictorial view of a further modified waste bag support.
Figure 4A:
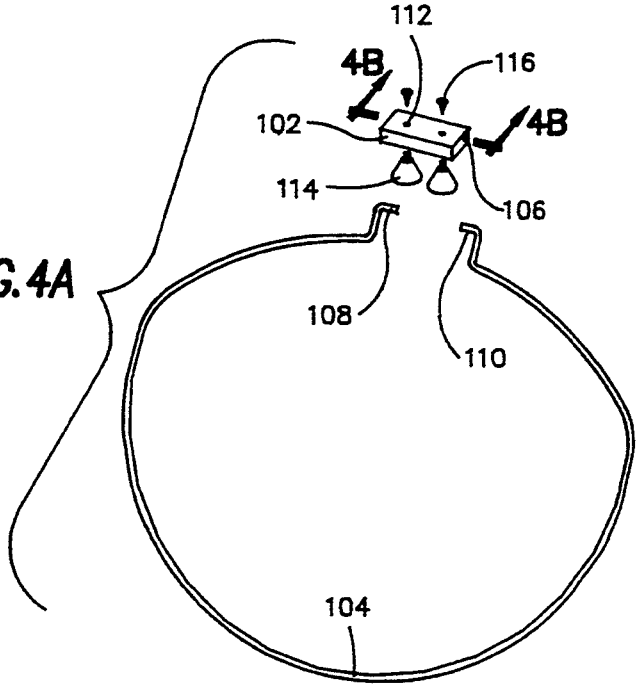
FIG. 4A is pictorial view of the support frame.
Figure 4B:
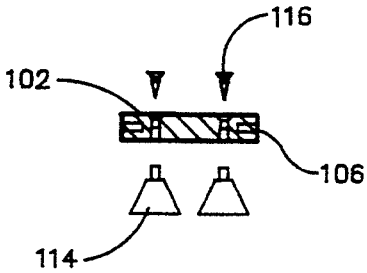
FIG. 4B is a view in section taken on line 4B—4B of FIG. 4A.

A further modified waste bag support device 100 is shown in FIGS. 4, 4A and 4B. A sink having a rounded rather than a sharp corner is employed. A hinged support block 102 is used for the support frame 104. Side holes 106 receive legs 108 and 110 of the support frame, while vertical holes 112 receive suction cups 114 with tapped holes. Screws 116 are employed to anchor the suction cups in the support block. The hinged support frame is then employed as previously described.

Figure 5:
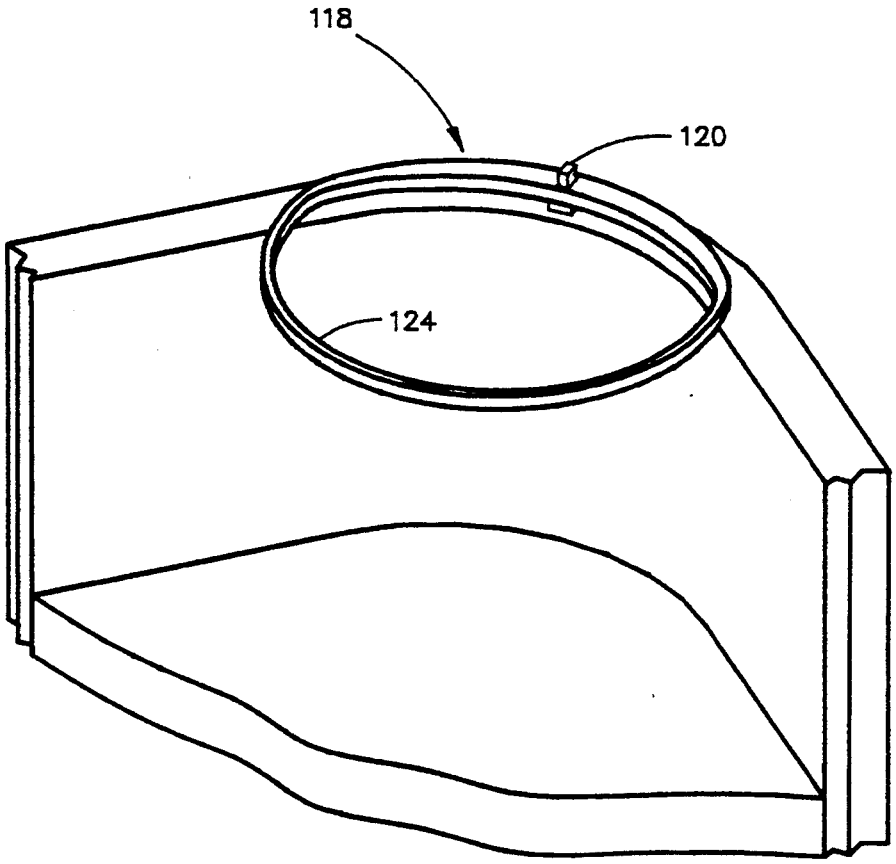
FIG. 5 is a pictorial view of a further modified waste bag support.
Figure 5A:
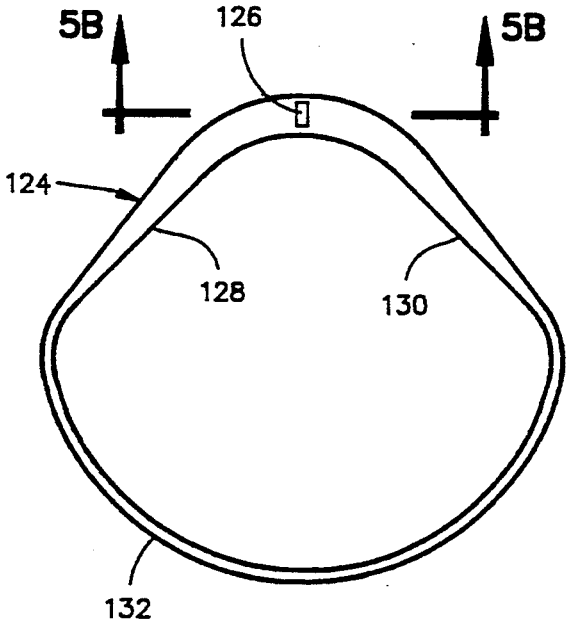
FIG. 5A is a plan view of the support frame.
Figure 5B:
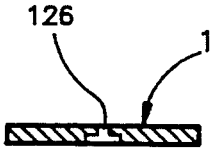
FIG. 5B is a view in section taken on line 5B—5B of FIG. 5A.
Figure 5C:
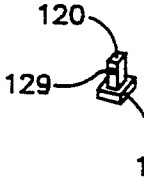
FIG. 5C is a pictorial view of a support pin for the support frame.

A further modified waste bag support device 118 is shown in FIGS. 5C. A vertical pin 120 having a base 122 is adhesively secured to the corner 44 of the sink. Cement or double faced adhesive tape may be employed as desired. A support frame 124 having an opening 126 registering with the pin 120 is used to clamp folded top edges of the waste bag to the top of the sink as previously described. The support frame 124 has substantially right angled legs 128 and 130 which by their weight and geometry of the frame, support the entire frame upon the sink corner. The hypotenuse 132 is rounded as in the previous modifications of FIG. 3 and 28 to present a partially rounded bag opening. Where desired, the legs 128 and 130 may be made wider or weighted to increase the stability of the support on the sink corner. A round projection 129, on pin 120 ensures or keeps the support frame on the pin.

Figure 6:
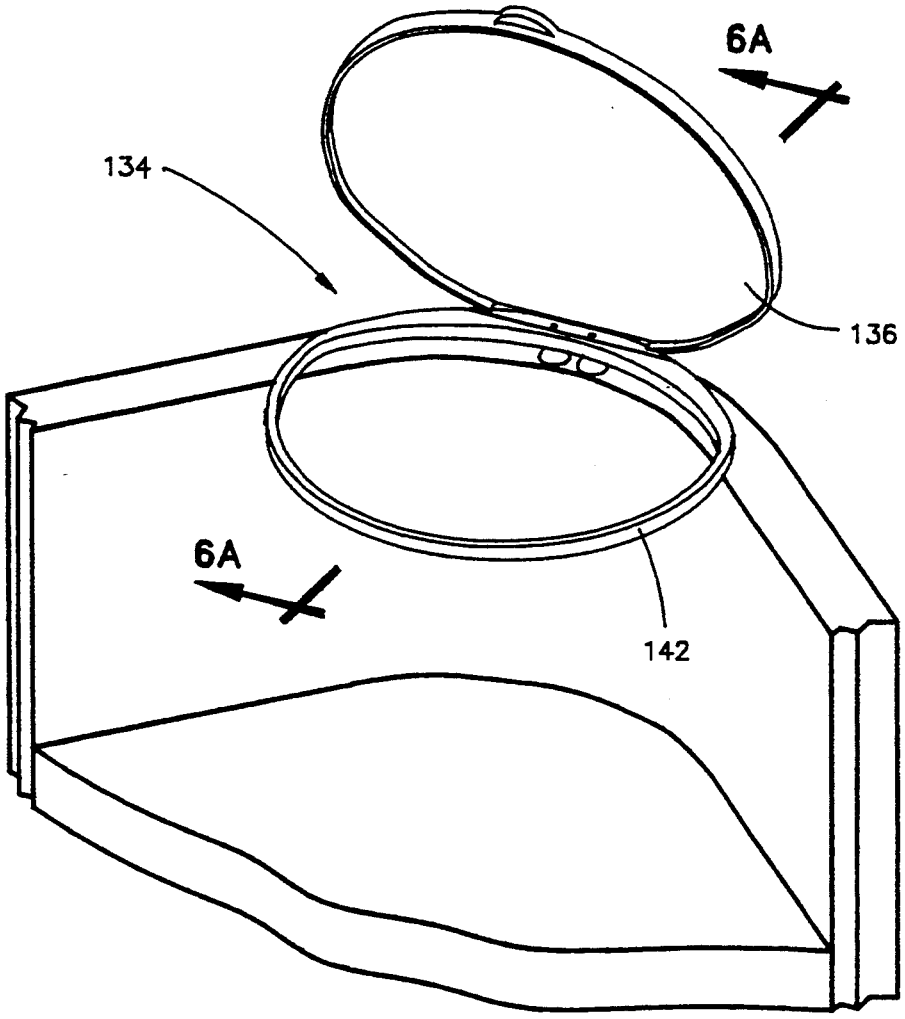
FIG. 6 is a pictorial view of a further modified waste bag support.
Figure 6A:
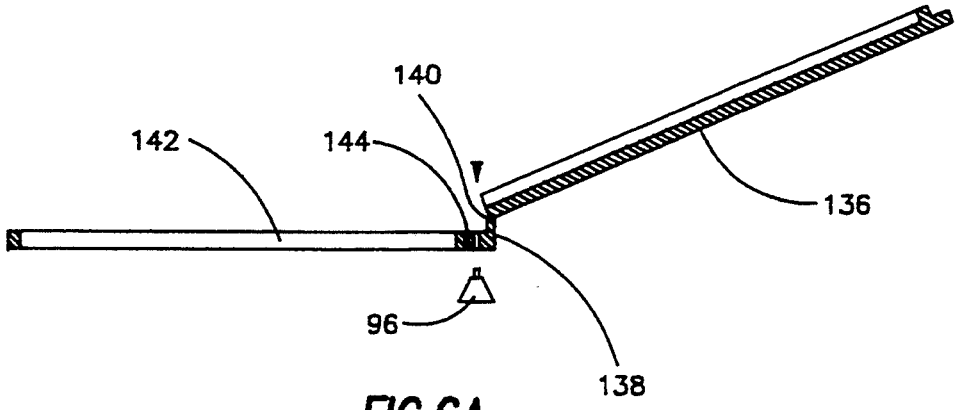
FIG. 6A is a view in section taken on line 6A—6A of FIG. 6.

A further modified waste bag support device 134 is shown in FIGS. 6 and 6A. This modification is similar to that of support device 92 in FIG. 3, except that a lid 136 connected to a hinge block 138 by a flexible hinge 140 is employed. For additional ease in hinging of the support frame 142, an additional strap-like flexible hinge 144 is also employed.

A further modified waste bag support device 146 is shown in FIGS. 7–7F. This device is shown connected to the top of side wall 42, but may also (not shown) be connected at the corner 44 of the sink. A hinge block 148 is connected by suction cups 150 to the horizontal rim 42 a distance away from the edge to clamp a portion of the folded over top edge of the waste bag between the rim and the hinged support frame 152.

The support block, through openings 154 receives turned in legs 155 and 156 of the support frame. Set screws 160 retain the suction cups 150 through tapered openings in the suction cups. A lid 162 having "over the center grooves" 164 is snapped over a support rod 166 in order that the lid may be raised and lowered.

Figure 8:
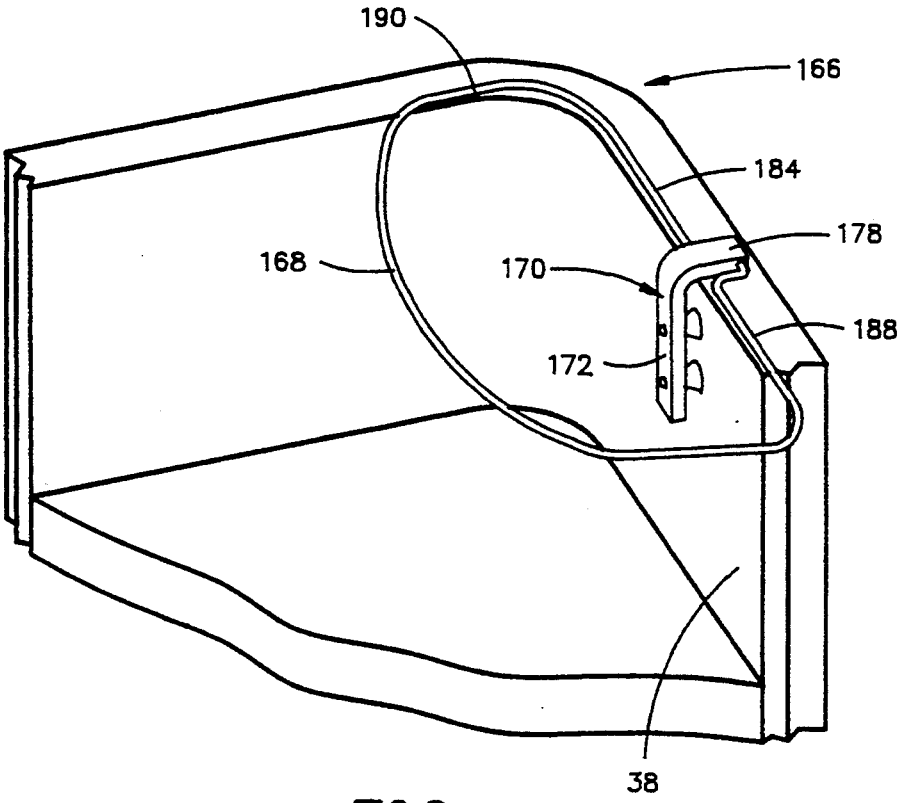
FIG. 8 is a pictorial view of a further modified waste bag support on a side rim of the sink.
Figure 8A:
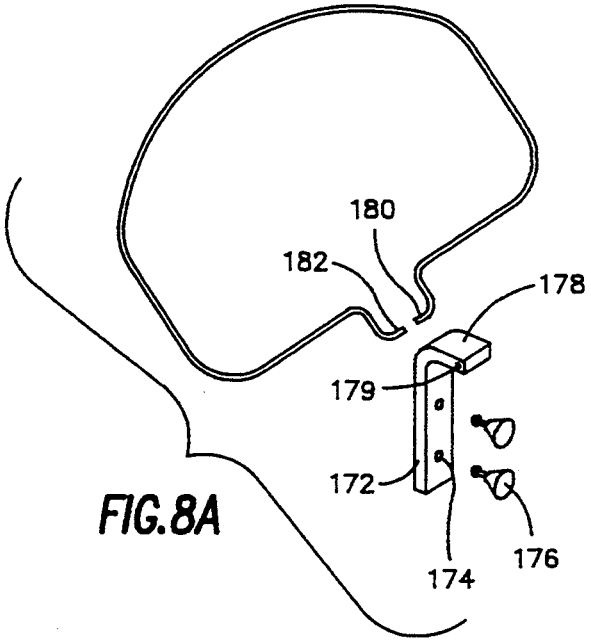
FIG. 8A is a pictorial view showing the support frame connection to a support hinge.
Figure 8C:
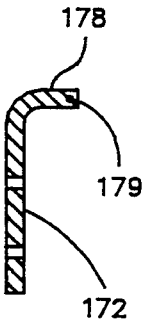
FIG. 8C is a view in section taken on line 8C—8C of FIG. 8B.
Figure 8B:
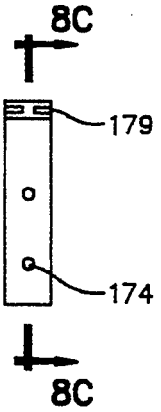
FIG. 8B is a view in front elevation of the support hinge.

A further modified waste bag support device 166 is shown in FIGS. 8–8C. A substantially "D"-shaped support frame 168 partially rectangular with a rounded outside portions is shown at the corner 44 of the sink but may also be employed at a straight portion of the sink rim (not shown). An "L" shaped hinge support block 170 is employed with a vertical leg 172 receiving through "snap-in" opening 174 suction cups 176 for affixation to a side wall 38 of the sink. A horizontal leg 178 overlies the sink and has openings 179 receiving inturned legs 180 and 182 of the support frame. The folded over top edges of the waste bag are clamped between the sink and the straight leg portions 184 and 188 and a side leg portion 190 of the support frame.

Figure 9:
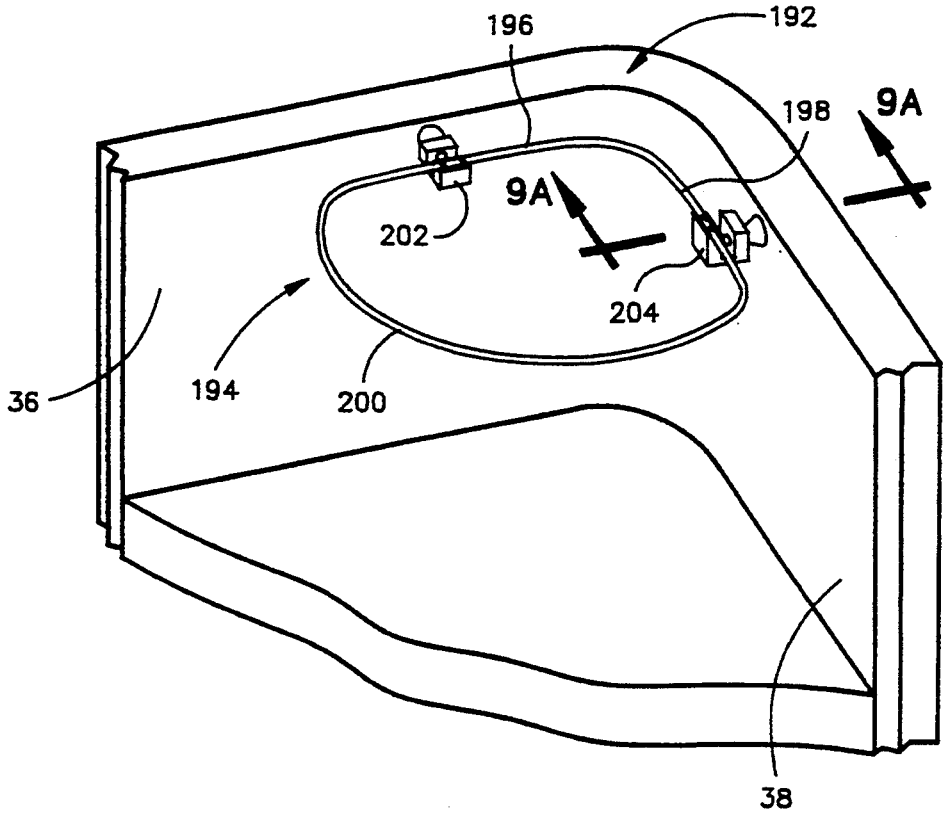
FIG. 9 is a pictorial view of a further modified waste bag support.
Figure 9B:
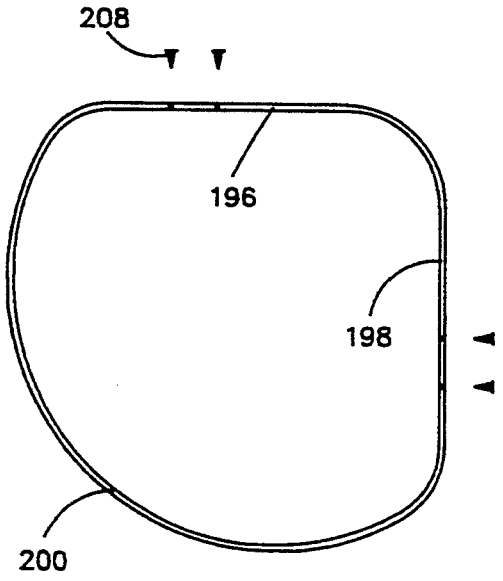
FIG. 9B is a top plan view of the support frame.
Figure 9A:
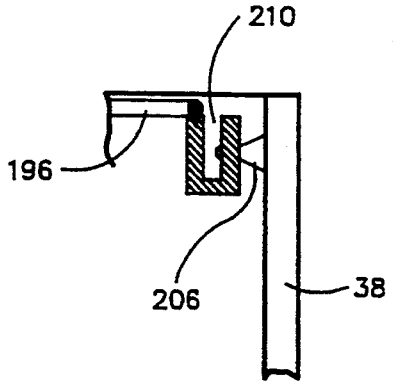
FIG. 9A is a view in section taken on line 9A—9A of FIG. 9.

A further modified waste bag support device 192 is shown in FIGS. 9–9B. In this modification, a support frame 194 generally triangular configuration having legs 196 and 198 and a rounded hypotenuse 200 is supported at an elevated portion of the corner of side walls 36 and 38 of the sink. Support blocks 202 and 204 are connected by suction cups 206 as in prior examples. The legs 196 and 198 are connected to the top of the support blocks by screws 208.

Each of the support blocks is provided with a groove or gutter 210 into which the folded over top edges of the waste bag may be tamped for positioning and retaining the waste bag. Spacing of the support frame from the interior surface of the sink wall provides a further area for clamping reception of the folded over top edges of the waste bag.

Figure 10:
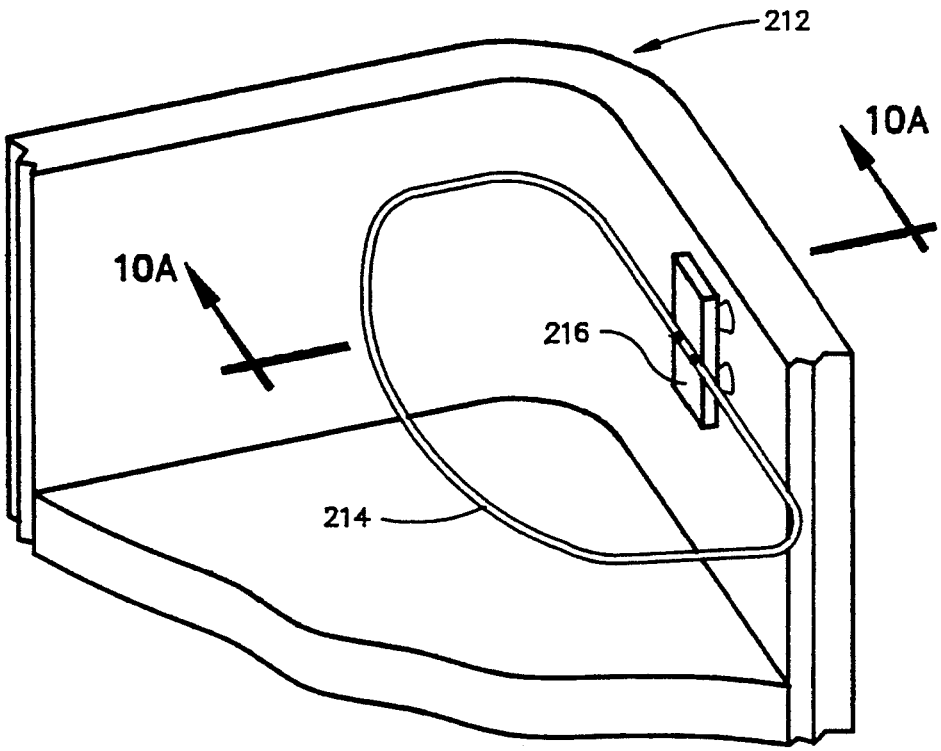
FIG. 10 is a pictorial view of a further modified waste bag support.
Figure 10A:
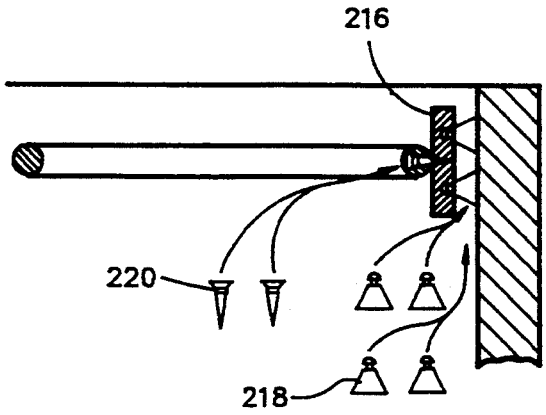
FIG. 10A is a view in section taken on line 10A—10A of FIG. 10.

A further modified waste bag support device 212 is shown in FIGS. 10 and 10A. This device is similar to that of FIG. 9, but a somewhat "D" shaped support frame 214 is employed. It is supported at an elevated portion of the side wall adjacent the corner 44 of the sink, but may also be employed away from the corner. A support block 216 is connected to the side wall by suction cups 218. The support frame is connected by screws 220 to the support block. The plastic construction or metallic wire, should that be employed, enables the folded over top edges of the waste bag to be tucked between the support frame and the sink side wall with a biased action due to the flexibility of the support frame.

Figure 11:
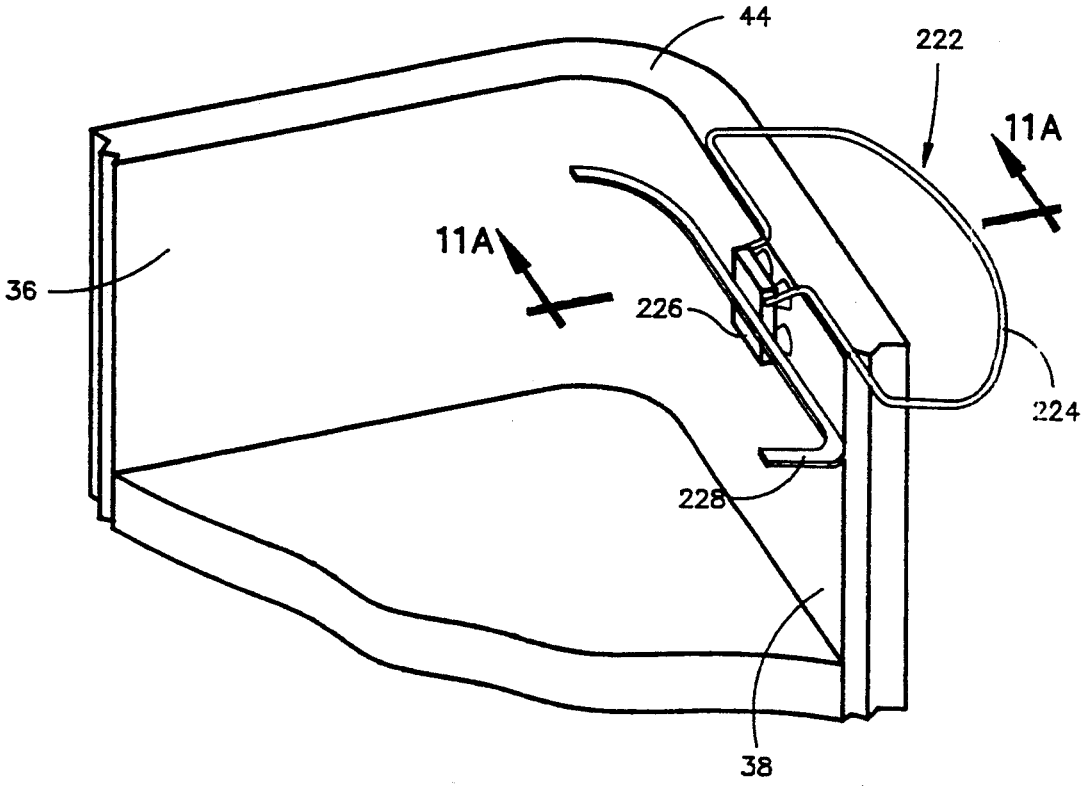
FIG. 11 is a pictorial view of a further modified waste bag support on a side wall of the sink.
Figure 11A:
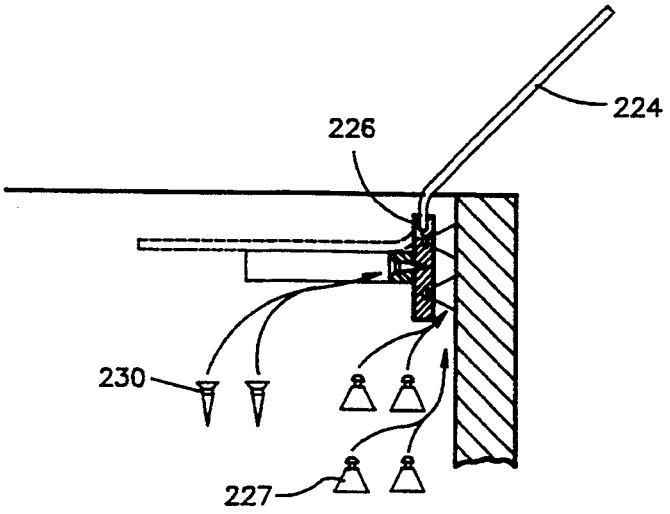
FIG. 11A is a view in section taken on line 11A—11A of FIG. 11.

A further modified waste bag support device 222 is shown in FIGS. 11 and 11A. In this modification a "D" support frame 224 is hingedly connected to a support block 226 connected by suction cups 227 to the side wall 38 of the sink adjacent the corner 44 and side wall 36. A wide "U" shaped support base 228 is affixed to the support block by screws 230.

The support frame is hingedly supported on the support block by inturned legs fitted into holes in the support block as in previous modifications. The support base provides further clamping support when the folded over edges of the waste bag are fitted between it and the support frame.

Figure 12:
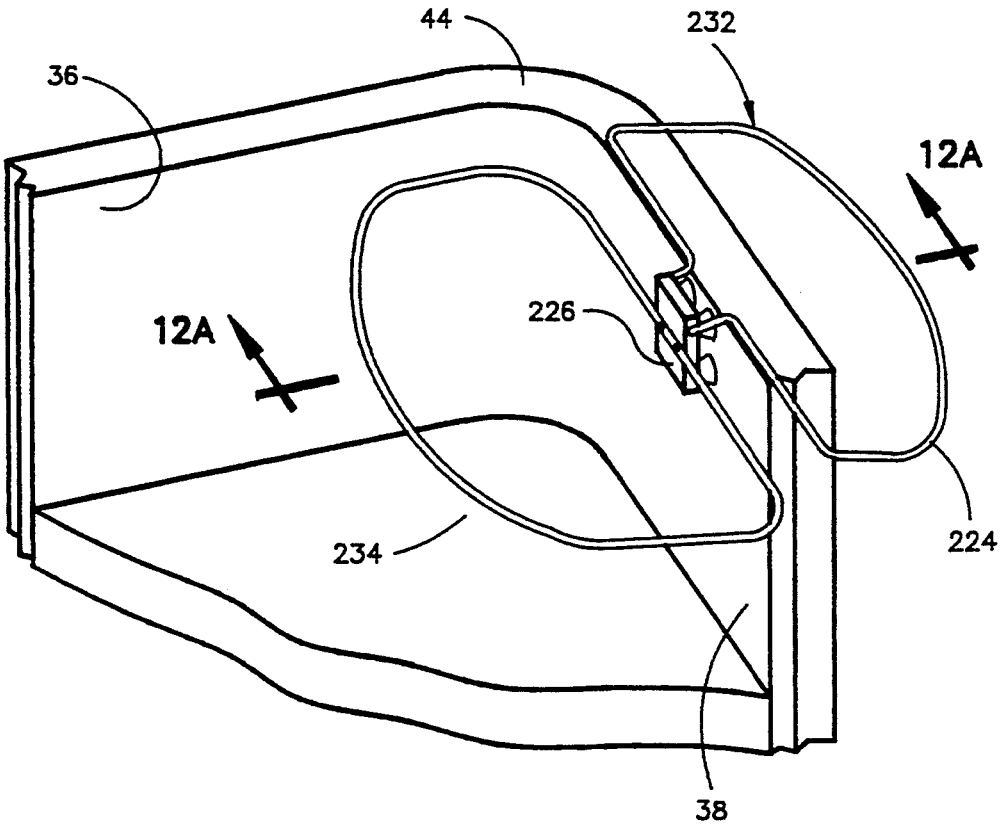
FIG. 12 is a pictorial view of a further modified waste bag support on a side wall of the sink.
Figure 12A:
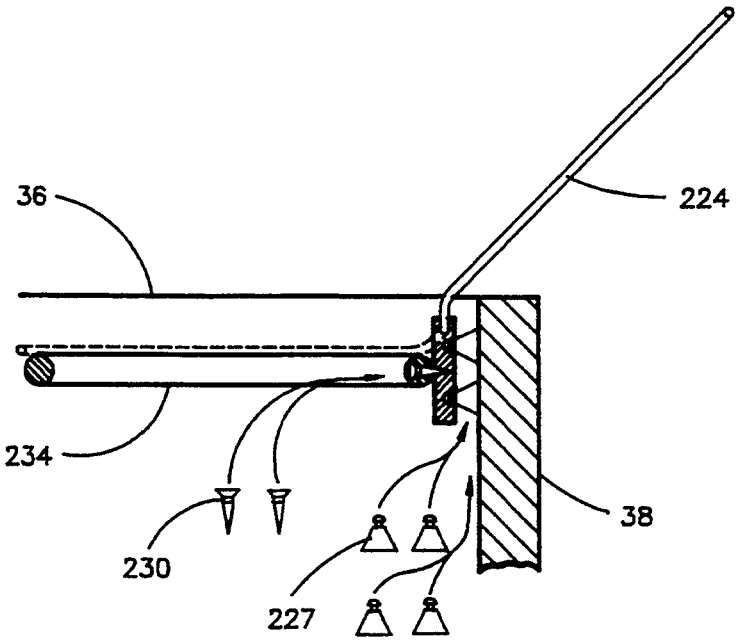
FIG. 12A is a view in section taken on line 12A—12A of FIG. 12.

A further modified waste bag support device 232 is shown in FIGS. 12 and 12A. This device is similar to FIG. 11, except that a "D" shaped support base 234 is employed that is congruent with the support frame 224 and completely underlies it for complete support and clamping action.

A further modified waste bag support 240 is shown in FIGS. 13 through 13E. A foldable support frame 242 is comprised of a first frame portion 244 and second portion 246 pivotally connected together by a hinge 248. The two portions are generally congruent with one another and are adapted to be opened to the position shown in FIG. 13 to provide an opening to receive a bag therein with edges folded over the frame and the bag bottom supported on the floor of the sink as previously described.

The top edges of the bag are folded over with a portion being stuffed into a gag or throat 250 comprised of a pair of studs separated by a narrow channel shown in FIG. 13 and FIG. 13D. The throat receives a top edge of a bag, such as a plastic bag which is anchored therein.

The first portion 242 of the frame in the frame open position may be raised at the intermediate portion to receive folded over edges of the bag which is secured between this portion of the frame and the corner of the sink.

The second portion 246 of the frame with the bag top edge folded over is adapted to be turned or pivoted to the position shown in dotted lines in FIG. 13 to close the top of the bag. This effectively closes the top of the bag to seal the waste content of the bag until the frame is reopened for further use or the waste bag is discarded.

The frame 242 is supported upon an elevated side wall portion of the sink corner by a base 252 provided with suction cups 254 for ready attachment to the sink walls. The base is provided with a sleeve 256 which rotatably receives a leg 258 of the inner portion of the frame. A similar construction is provided for the other side wall of the sink corner to receive the other leg 260 of the inner portion of the frame. The provision for relative rotation between the frame legs and the base permits the base and frame to be folded in a flat configuration for storage, packaging and shipment.

The hinge 248 as shown in FIG. 13B and FIG. 13E is provided by a stub shaft 262 on leg 264 of the second portion 246 of the frame which is rotatably received in opening 266 of leg 260 of the first portion of the frame. A lip 268 underlies the leg 264 in the frame open position to hold the frame open with the second portion and first portion of the frame in a planar configuration.

In the aforementioned description, plastic, because of its rigidity and slight flexibility, is generally employed for the support base, support frame and support block. Metal may employed or plastic coated or rubber coated metal and other suitable materials of construction may also be utilized where appropriate as will be well understood.

Various changes and modifications may be made within this invention as will be apparent to those skilled in the art. Such changes and modifications are within the scope and teaching of this invention as defined in the claims appended hereto.

What is claimed is:

1. A sink device for supporting a flexible garbage bag in a sink, said device comprising a frame having an open center portion through which said bag may be interfitted with a bottom of the bag resting on a floor of the sink, said frame having intersecting legs adapted to rest upon two intersecting rims of the sink forming a corner of said sink, said corner legs receiving folded over top portions of the bag in close proximity with said corner rims with an additional leg of said frame receiving a further folded over top portion of the bag to present a frame supported open mouth of the bag to receive garbage material, a portion of said frame being moveable from a rest position above said corner rim to a raised position to receive a top edge portion of said bag, back to the rest position overlying said edge portion of said bag and the corner rims and top surface of the sink to secure said top edge portion of the bag therebetween.

2. The sink device of claim 1 in which said frame is provided with hinge means to open said frame from a rest position upon the corner rims of said sink to an open position to provide for clamping engagement and disengagement of said bag.

3. The sink device of claim 2 in which said hinge means is supported by suction cup means at an elevated portion of the sink.

4. The sink device of claim 2 in which said device comprises a lower base member and an at least partially congruent upper member, said upper frame member being moveable through said hinge means between an open position to receive said folded over top portions of the bag and a closed bag clamping position resting upon said lower base member.

5. The sink device of claim 4 in which said device is supported by suction cup means at an elevated portion of the sink.

6. The sink device of claim 1 in which said frame is freely supported upon the corner of the sink rim and has sufficient weight to hold the folded over top portions of the bag in clamping relation between the rim and the frame.

7. The sink device of claim 1 in which said device comprises a lower base member and an at least partially congruent upper frame member, said upper frame member being moveable through hinge means between an open position to receive side folded over top portions of the bag and a closed bag clamping position resting upon said lower base member.

8. A sink device for supporting a flexible garbage bag in a sink, said device comprising a frame having an open center portion through which said bag may be interfitted with a bottom of the bag resting on a floor of the sink, said frame being supported by hinge means at an elevated portion of the sink, said device being supported by suction cup means at said elevated portion of the sink, said frame being moveable from a raised position to receive a top of the bag with folded over top edge portions over the frame to a rest position where a section of the folded over portion of the top of the bag is clamped between the frame and the sink.

9. The sink device of claim 8 in which said device comprises a lower base member and an at least partially congruent upper frame member, said upper member being moveable through said hinge means between an open position to receive said folded over top portions of the bag and a closed bag clamping position resting upon said lower base member.

10. The sink device of claim 8 in which a hinged lid is provided for the frame, said lid being generally congruent with said frame.

11. A sink garbage collecting device comprising a sink having a floor, upstanding walls forming a corner and rims at a top portion of said walls extending horizontally from said corner, a frame for supporting a garbage bag upon said floor, said frame having an open center portion through which said bag may be interfitted with a bottom of the bag resting on said floor of the sink, said frame having intersecting legs, means for supporting said frame at an upper portion of said sink in spaced relation above the floor, said legs receiving folded over top portions of the bag to provide an open mouth of the bag, said legs being moveable to a bag retaining position in close proximity with the sink with the folded over top portions of the bag secured between said legs and the top portion of the sink.

12. The sink garbage collecting device of claim 11 in which said frame has two intersecting corner legs adapted to rest upon corner rims of the sink, said corner legs receiving the folded over top portions of the bag in clamping relation against said corner rims of the sink.

13. The sink device of claim 11 in which said frame is provided with hinge means to open said frame from a rest position upon the corner rims of said sink to an open position to provide for clamping engagement and disengagement of said bag.

14. The sink device of claim 13 in which said hinge means is supported by a support block connected by suction cup means at an elevated portion of the sink.

15. The sink device of claim 11 in which said device comprises a lower base member and an at least partially congruent upper frame member, said upper frame member being moveable through hinge means between an open position to receive said folded over top portions of the bag and a closed bag clamping position resting upon said lower base member.

16. A sink garbage collecting device comprising a sink having a floor, upstanding walls forming a corner and rims at a top portion of said walls extending horizontally from said corner, a frame for supporting a garbage bag upon said floor, said frame having an open center portion through which said bag may be interfitted with a bottom of the bag resting on said floor of the sink, said frame having intersecting legs, means for supporting said frame at an upper portion of said sink in spaced relation above the floor, said legs receiving folded over top portions of the bag to provide an open mouth of the bag, said frame having first and second portions, hinge means connecting said portions to one another, at least one of said first and second portions being moveable from an open bag receiving position to a closed position with said first and second portions in close proximity and closing an open top of the bag.

17. The sink device of claim 16 in which said second portion of the frame is provided with a bag retaining member connected to the outer portion by a narrow neck channel, said narrow neck channel serving to receive a stuffed bag portion into the bag retaining member.

18. The sink device of claim 16 in which the hinge means has a stop element holding said second portion in a planar position with said first portion in the open bag receiving position.

19. The sink device of claim 16 in which said second portion of the frame is provided with a bag retaining member connected to the second portion by a narrow neck channel, said narrow neck channel serving to receive a stuffed bag portion into the bag retaining member, said hinge means has a stop element holding said second portion in a planar position with said first portion in the open bag receiving position.

20. The sink device of claim 16 in which said first portion is pivotally connected to a suction cup support means attached to an elevated portion of the sink, said support means receiving said first support frame in rotatable relation, said second and first frame portions and said support means being foldable in overlapping relation for storage and packing.

21. The sink device of claim 16 in which said hinge means is connected to said means for supporting said frame at an upper portion of said sink and both frame portions are turnable from an open bag receiving position to a closed position.

* * * * *